US005564603A

United States Patent [19]

Malmberg

[11] Patent Number: 5,564,603

[45] Date of Patent: Oct. 15, 1996

[54] POURING SPOUT HAVING A FRANGIBLE SEAL

[75] Inventor: Christer Malmberg, Nymölla, Sweden

[73] Assignee: Tetra Laval Holdings & Finance S.A., Pully, Switzerland

[21] Appl. No.: 310,771

[22] Filed: Sep. 27, 1994

[30] Foreign Application Priority Data

Oct. 15, 1993 [SE] Sweden ..... 9303402

[51] Int. Cl.[6] ..... B67D 5/33

[52] U.S. Cl. ..... 222/153.06; 222/541.5; 222/541.6; 215/232; 215/252; 215/258

[58] Field of Search ..... 222/153.06, 541.1, 222/541.5, 572, 541.6; 215/252, 232, 258, 341, 349

[56] References Cited

U.S. PATENT DOCUMENTS

| | | | |
|---|---|---|---|
| 4,813,578 | 3/1989 | Gordon et al. | 222/541 |
| 4,892,217 | 1/1990 | Shastal | 222/153.6 |
| 5,125,529 | 6/1992 | Torterot | 215/232 |
| 5,199,618 | 4/1993 | Reil et al. | 222/541.5 |
| 5,265,745 | 11/1993 | Pereyra et al. | 215/232 |
| 5,372,284 | 12/1994 | Mock | 222/541.6 |

FOREIGN PATENT DOCUMENTS

| | | |
|---|---|---|
| 0505851 | 9/1992 | European Pat. Off. . |
| 468893 | 4/1993 | Sweden . |
| 469025 | 5/1993 | Sweden . |
| 1499433 | 2/1978 | United Kingdom . |

*Primary Examiner*—Andres Kashnikow
*Assistant Examiner*—Philippe Derakshani
*Attorney, Agent, or Firm*—Burns, Doane, Swecker & Mathis

[57] ABSTRACT

The invention relates to an opening arrangement of the type which consists of a pouring spout (3) formed from a thermoplastic material sheet (1) and surrounded by an outer closure portion (2). The outer closure portion (2) is sealed partly to the upper wall (4) of the pouring spout (3) and partly to a portion of the material sheet (1) surrounding the pouring spout (3). The outer closure portion (2) is provided with a failure impression (7) placed circularly around the outer closure portion (2) when this is sealed to the material sheet (1).

9 Claims, 1 Drawing Sheet

POURING SPOUT HAVING A FRANGIBLE SEAL

TECHNICAL FIELD

The present invention relates to an opening arrangement of the type which consists of a pouring spout which is formed from a thermoplastic material sheet and is surrounded by an outer closure portion, the outer closure or sealing portion being sealed to the upper wall of the pouring spout.

BACKGROUND OF THE INVENTION

It is previously known in the art to thermoform a pouring spout on a liquid package from, for example, Swedish Patent Application No. SE 9100921-7. According to this method, a pouring spout is formed from a sheet of thermoplastic material, the spout being enclosed by an outer closure portion, a so-called screw cap.

The thermoplastic material sheet may comprise the entire upper side of a package which otherwise consists of a packaging laminate with a core of paper or paperboard to which different layers are laminated, the outermost layer being thermoplastic. The cross section of the package may be circular or rectangular. The thermoplastic material sheet may also consist of a minor portion, covering a cut-out piece from a conventional laminate package so that it is welded in place against the inside of the laminate package of thermoplastic material. One such package may, for example, be a so-called gable-top package.

In one of the above-described package types—which is finished inasmuch as it consists of side walls and a top wall, a pouring spout is formed in the top wall. A forming tool is passed through the as yet incomplete bottom of the package, and an outer closure portion (a so-called screw cap) is lowered from the upper side of the package, the closure portion serving as a mould for forming the pouring spout. When the pouring spout has been formed in this way, the upper portion of the pouring spout is sealed in place against the inside of the upper closure portion. This sealing or closure is intended to be broken when the package is opened. However, this method gives no external indication that the package has been tampered with or illicitly opened so that its contents might have been manipulated. Since this applies to packages for sensitive foods, it is often desirable to provide the package with an opening arrangement of the type which immediately indicates whether or not the package has been improperly opened before reaching the consumer.

OBJECTS AND SUMMARY

One object of the present invention is to provide an opening arrangement of the above-outlined type with a simple, visual indication that the package has not previously been opened and which does not impede opening of the packaging container.

This and other objects have been attained according to the present invention in that an opening arrangement of the type described by way of introduction has been given the characterizing feature that the closure portion is also sealed to a portion of the material sheet surrounding the pouring spout, and that the outer sealing portion is provided with a failure impression.

BRIEF DESCRIPTION OF THE ACCOMPANYING DRAWING

One preferred embodiment of the present invention will now be described in greater detail hereinbelow, with reference to the accompanying Drawing, in which:

FIG. 1 is a side view of the opening arrangement, partly in section.

DESCRIPTION OF PREFERRED EMBODIMENT

Figure 1:
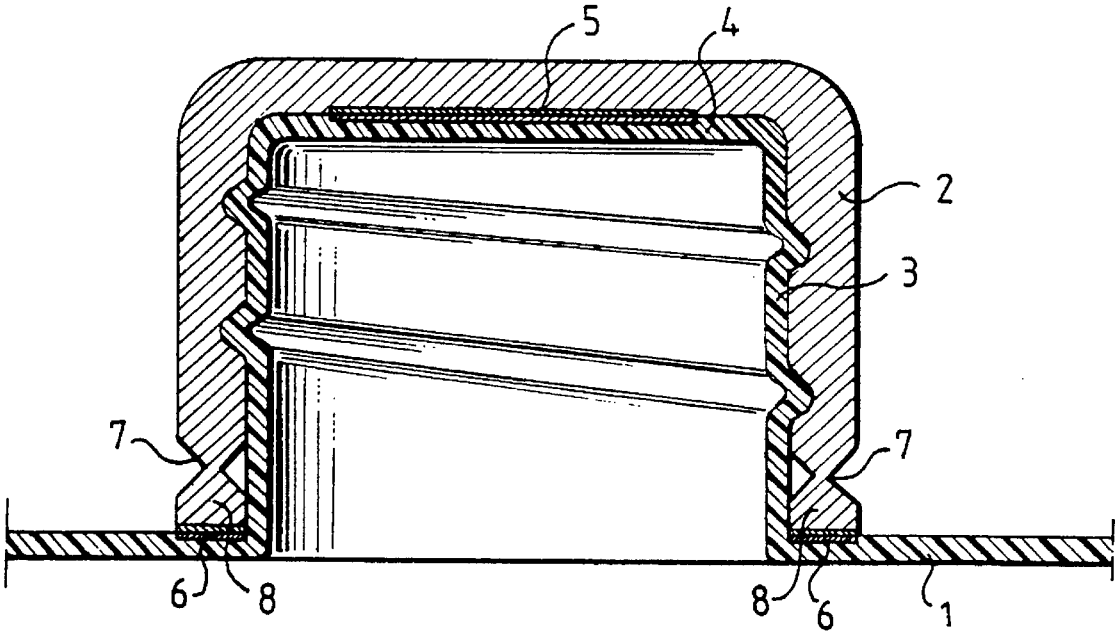

An opening arrangement of the type which the present invention represents may be made on different package types. One such package type consists of side walls of a laminate with a core of paper or paperboard to which is laminated an outer layer of thermoplastic, and the package is further provided with an upper wall 1 wholly consisting of thermoplastic. Other package types are conventional gable-top packages or parallelepipedic packages in whose upper wall a panel is cut out which is covered from the underside by a thermoplastic layer.

Irrespective of package type, the opening arrangement is made in an identical manner. The as yet unfinished package, which is still open at the bottom, is mounted on a mandrel, and a forming tool is introduced via the package bottom. Simultaneously, an outer closure portion 2 is advanced towards the upper side of the package. The outer closure portion 2 is employed as a mold for thermoforming of a pouring spout 3 which is formed from the thermoplastic material layer, which either constitutes the upper side 1 of the package, or a part of the upper side 1.

Once the pouring spout 3 has been formed from the thermoplastic material sheet with the outer closure portion 2 as mold, the forming tool is removed from the packaging container and the upper wall 4 of the pouring spout 3 is permanently sealed by ultrasonic means against the inside of the outer sealing or closure portion 2. FIG. 1 shows an outer closure portion 2 in which is formed a pouring spout 3 from a thermoplastic material sheet. On one surface 5, the upper wall 4 of the pouring spout 3 is sealed to the inside of the outer closure portion 2 and, in the same production phase, the lower outer diameter of the outer closure portion 2 is sealed against that portion of the thermoplastic material sheet 1 which surrounds the pouring spout 3. There will thus here be obtained two seals 5 and 6 in the same production phase, of which the one seal, 6, is circular and retains the outer closure portion 2 against the upper side of the package.

As is shown in FIG. 1, the outer closure portion 2 is provided, a short distance from its lower defining surface, with a failure impression 7 inasmuch as the outer closure portion 2 is of lesser material thickness around its circumference. This failure impression may be designed in different ways such that the attenuated wall abuts against the pouring spout 3 or, alternatively, is oriented outwardly towards the outer side of the closure portion 2, or, as shown in the Figure, is attenuated equally from both sides.

The thus far finished packaging container is now removed from the mandrel, filled with its intended contents and sealed in its bottom.

When the packaging container carrying an opening arrangement according to the present invention reaches the consumer, the consumer is able to rapidly ascertain that the package has not been illicitly opened in that the failure impression 7 which surrounds the outer sealing portion 8 is unbroken. When the consumer opens the packaging container, the surface 5 of the thermoplastic material in the upper portion 4 of the pouring spout 3 is broken where it was sealed against the inside of the outer closure portion 2. At the same time, the circular failure impression 7 is twisted off so that the lowermost portion 8 of the closure portion 2 remains on the upper side 1 of the packaging container when the closure portion 2 is removed from the pouring spout 3.

An opening arrangement according to the present invention is reclosable in that the outer closure portion can once again be screwed back in place on the pouring spout until it reaches the circular failure line.

As will have been apparent from the foregoing description, the present invention realises an opening arrangement which, in a simple and economical manner, makes it possible rapidly to ascertain that the package has not been improperly opened or tampered with before reaching the consumer's hand, at the same time as the opening arrangement is easy to reclose.

While this invention has been illustrated and described in accordance with a preferred embodiment, it is recognized that variations and changes may be made therein without departing from the invention as set forth in the claims.

What is claimed is:

1. An opening arrangement comprising:

a pouring spout formed from a thermoplastic sheet, said pouring spout having an upper wall;

an outer closure portion surrounding said pouring spout;

a first seal between the outer closure portion and the upper wall of the pouring spout;

a second seal between the outer closure portion and a portion of the thermoplastic sheet surrounding said pouring spout; and a failure impression on the outer closure portion.

2. The opening arrangement of claim 1, wherein the second seal is circular.

3. The opening arrangement of claim 1, wherein the failure impression is close to the second seal.

4. The opening arrangement of claim 1, wherein the failure impression follows a circumference of the outer closure portion.

5. The opening arrangement of claim 1, wherein both the first seal and the second seal are made in the same production phase.

6. The opening arrangement of claim 1, wherein the outer closure portion has a substantial cylindrical outer surface and a substantially cylindrical inner surface.

7. The opening arrangement of claim 6, wherein the failure impression is formed in the outer surface of the outer closure portion.

8. The opening arrangement of claim 6, wherein the failure impression is formed in the inner surface of the outer closure portion.

9. The opening arrangement of claim 6, wherein a first failure impression is formed in the outer surface of the outer closure portion and a second failure impression is formed in the inner surface of the outer closure portion such that a frangible portion is formed between the first and second failure impressions.

* * * * *